United States Patent [19]

Katsumata

[11] Patent Number: 4,541,812

[45] Date of Patent: Sep. 17, 1985

[54] ILLUMINATING TOY UTILIZING CAPTIVE LIGHT CONDUCTING ELEMENTS

[75] Inventor: Fuyuki Katsumata, Tokyo, Japan

[73] Assignee: Tomy Kogyo Company, Incorporated, Japan

[21] Appl. No.: 516,639

[22] Filed: Jul. 25, 1983

[51] Int. Cl.[4] ..... A63H 33/04

[52] U.S. Cl. ..... 446/91; 446/485; 446/118; 40/451

[58] Field of Search ..... 446/85, 91, 105, 118, 446/485; 40/447, 450, 451, 452, 547

[56] References Cited

U.S. PATENT DOCUMENTS

| | | | |
|---|---|---|---|
| 1,720,441 | 7/1929 | Rivkin | 40/452 |
| 1,845,530 | 2/1932 | Tarallo | 40/547 |
| 2,096,360 | 10/1937 | Heller | 40/452 |
| 2,149,363 | 3/1939 | Rivkin | 446/118 |
| 2,151,236 | 3/1939 | Schwartz et al. | 40/452 |
| 3,530,615 | 9/1970 | Meyer | 446/91 |
| 3,568,357 | 3/1971 | Lebensfeld | 446/91 |
| 4,115,941 | 9/1978 | Stephenson | 40/452 |
| 4,196,539 | 4/1980 | Speers | 446/118 |

*Primary Examiner*—Robert A. Hafer
*Assistant Examiner*—Daniel Nolan
*Attorney, Agent, or Firm*—K. H. Boswell

[57] ABSTRACT

A toy for displaying an illuminated pattern has a first and second panel located in a housing, each panel including an equal number of a plurality of openings aligned with the openings of the other panel. Located between the panels are light conducting members and an opaque membrane having a plurality of apertures, both the light conducting members and the apertures equal in number to and aligned with the openings in the panels. The light conducting members are fixedly retained in the housing and are positionable in a first, or closed, position, and a second, or open, position in association with the panels. Each light conducting member is capable of being moved from its first to its second position. When the light conducting members are in the closed position, the apertures, which are closed, inhibit transmission of light through the light conducting members. When any light conducting member is depressed to the second, or open position, that light conducting member moves into at least partial engagement with the aperture with which it is aligned, thus temporarily completing an optical pathway between the opening in the second panel and the viewing surface of the toy. A reset means associated with the housing resets each of the light conducting members to its first, or closed position, allowing the user of the toy to create an unlimited number of new and different patterns at will.

18 Claims, 6 Drawing Figures

10
26
28
34
34
34
34
34
34
24
30
30
30
32
36
66
68
5
5
3
3

ILLUMINATING TOY UTILIZING CAPTIVE LIGHT CONDUCTING ELEMENTS

BACKGROUND OF INVENTION

This invention is directed to an illuminated toy which utilizes captive light conducting elements located between a first and a second perforated panel. A membrane having a plurality of closable perforations is associated with the light conducting elements, with light being conducted through the elements when the elements are located within the openings in the membrane, and light passage inhibited by the membrane when the elements are removed from the openings of the membrane.

A class of toys exist which utilize a light source incorporated in a housing. Two stacked plates are positioned in front of the light source with a plurality of holes formed in each plate, with the holes aligned with one another. An opaque material, such as a piece of black paper or the like is positioned between the plates to screen out the light. A design is then created on the plates by pushing a plurality of pointed pegs through the holes in one plate, through the opaque material and into the holes of the second plate, such that the ends of these pegs which are positioned through the second plate are then in the beam of light emitted from the light source. The pegs conduct this beam of light along their length and the pattern of light conducted by the totality of the pegs is visible outside of the toy to the user of the toy.

These toys are very entertaining and educational in that they challenge a child or an adult to create an interesting pattern and the like. The toy as described in the preceding paragraph requires that a separate opaque plate be utilized for each and every pattern, in that once the opaque plate is perforated by the pointed pegs, light will always shine through the perforations, and a pattern different from the original one made in the opaque material would be deteriorated by the extraneous light shining through the holes left from the original pattern.

Furthermore, with the type of toy discussed previously, the pointed pegs, by their very size and nature, are prone to getting lost with the passage of time and can present a safety hazard with small children because of the possibility of being inserted into an eye or other delicate organ, or of being swallowed by young children. Additionally during actual use of the games, the pegs tend to get scattered, stepped on and broken.

Modern lighting techniques for advertising and the like utilize liquid crystal displays, florescent screens and the like. These were preceded by wide scale use of neon tubing. This, in turn, was preceded by the use of certain display screens which incorporated spherical elements which were located between two perforated plates. The spherical elements were located in perforations in the plates to display messages and the like. Illumination of the spherical elemens with a light source resulted in illumination of the pattern or the like in which the spherical elements were arranged to result in a lighted sign or the like.

The signs created with the spherical elements discussed in the previous paragraph, however, were not easily amenable to changing of the indicia therein. The plates had to be dismantled with respect to one another such that the spherical elements could be rearranged between the plates, with the plates then repositioned with respect to one another to hold the spherical elements in any new arrangement. This obviously does not lend itself to use in toys or the like, because of the possibility of once again losing or scattering of the spherical elements and the difficulty in changing the pattern by having to physically remove one of the plates with respect to the other.

BRIEF DESCRIPTION OF THE INVENTION

In view of the above, it is a broad object of this invention to provide an illumination type toy of the type wherein light is conducted by light conducting elements, with the inclusion, however, of these light conducting elements being physically attached to the toy such that they cannot be separated nor lost from the toy, which would result in deterioration of the play value of the toy. It is a further object of this invention to provide a toy which, from a safety point of view, does not require the use of elongated and/or pointed elements which a small child could utilize in injuring him/her self. Additionally, it is an object of this invention to provide a toy which does not require the use of peg membranes which are not reusable to create different designs. Furthermore it is an object of this invention to provide a toy which, because of the engineering principles incorporated therein, and its ease of manufacturing, is economical to the consumer, and thus available to a large segment of the consuming public for enjoyment thereof.

These and other objects, as will become evident from the remainder of this specification are achieved in a toy for displaying an illuminated pattern which comprises: a housing; a first panel located in said housing; a second panel located in said housing and spaced away from said first panel at a fixed distance; said first panel including a plurality of first openings formed through said first panel; said second panel including a plurality of second openings formed through said second panel, the number of said second openings equal to the number of said first openings with each of said second openings aligned with one of said first openings and together each of said aligned first and second openings forming an optical pathway through said first and said second panels; an opaque membrane located between said first and said second panels, said opaque membrane having a plurality of aperture means for controlling the transmission of light through said membrane, the number of said aperture means equal in number to the number of said first and said second openings with one of said plurality of said aperture means positioned in each of said optical pathways between the respective first and second openings forming said optical pathway, each of said aperture means capable of being opened and closed and when open allowing light to be transmitted through said membrane and when closed inhibiting the transmission of light through said membrane; a plurality of light conducting members equal in number to the number of said first and said second openings, said light conducting members fixedly retained in said housing in a location between said first and said second panels, said number of said light conducting members equal in number to the number of said first and said second openings with one of said light conducting members positioned in each of said optical pathways between the respective first and second openings forming an optical pathway and positionable in said optical pathway between a first position wherein said light conducting member is located between said first panel and said opaque membrane and said aperture is closed and a second position wherein at least a portion of said light conducting member is positioned in said aperture means in said opaque membrane to open said aperture means; together said aperture means and said light conducting member associated with each of said optical pathways allowing or inhibiting light transmission through said optical pathway, light being transmitted through said optical pathway when said light conducting member is in said second position to open said aperture means, light transmission through said optical pathway being inhibited when said light conducting member is in said first position and said aperture means is closed.

In the preferred embodiment of the toy, a retaining means would be associated with the aperture means for retaining the aperture means open when the light conducting member which is associated with that particular aperture means is located in its second position. Preferredly, the retaining means would include each of said second openings having a projection means located in association with the second opening. The projection means would project from the second opening towards the opaque member. The light conducting member, when in its second position, would be positionable proximal to the projecting means with a portion of the opaque membrane which is associated with the crossed slits being pinched between the projection means and the light conducting member to frictionally engage the light conducting member, the portion of the opaque membrane and the projection means together to retain the light conducting member in its second position.

Preferredly, the projection means would comprise at least two projection members spaced around the periphery of the second openings. Preferredly, the second openings are quadrilaterally shaped and when so shaped the projection means would include four projection members symmetrically spaced about these second openings.

Preferredly, the first openings are round in cross section and frustoconical in axial section.

Preferredly, a reset means can be associated with the housing, with the reset means capable of resetting each of the light conducting members to their first position. Preferredly, the housing is movable with respect to the reset means, and as the housing moves with respect to the reset means, the reset means resets the light conducting members to the first position.

Preferredly, each of the aperture means comprises a pair of crossed slits formed in the opaque membrane with the crossed slits openable and closable, and when so open, completing the optical pathway through the opaque membrane.

Preferredly, the light conducting means would comprise spherical members formed of light transmitting material which would be capable of fitting into the crossed slits in the opaque membrane, to open the crossed slits to complete the optical pathway through the opaque membrane.

BRIEF DESCRIPTION OF THE DRAWINGS

This invention will be better understood when taken in conjunction with the drawings wherein.

Figure 1:
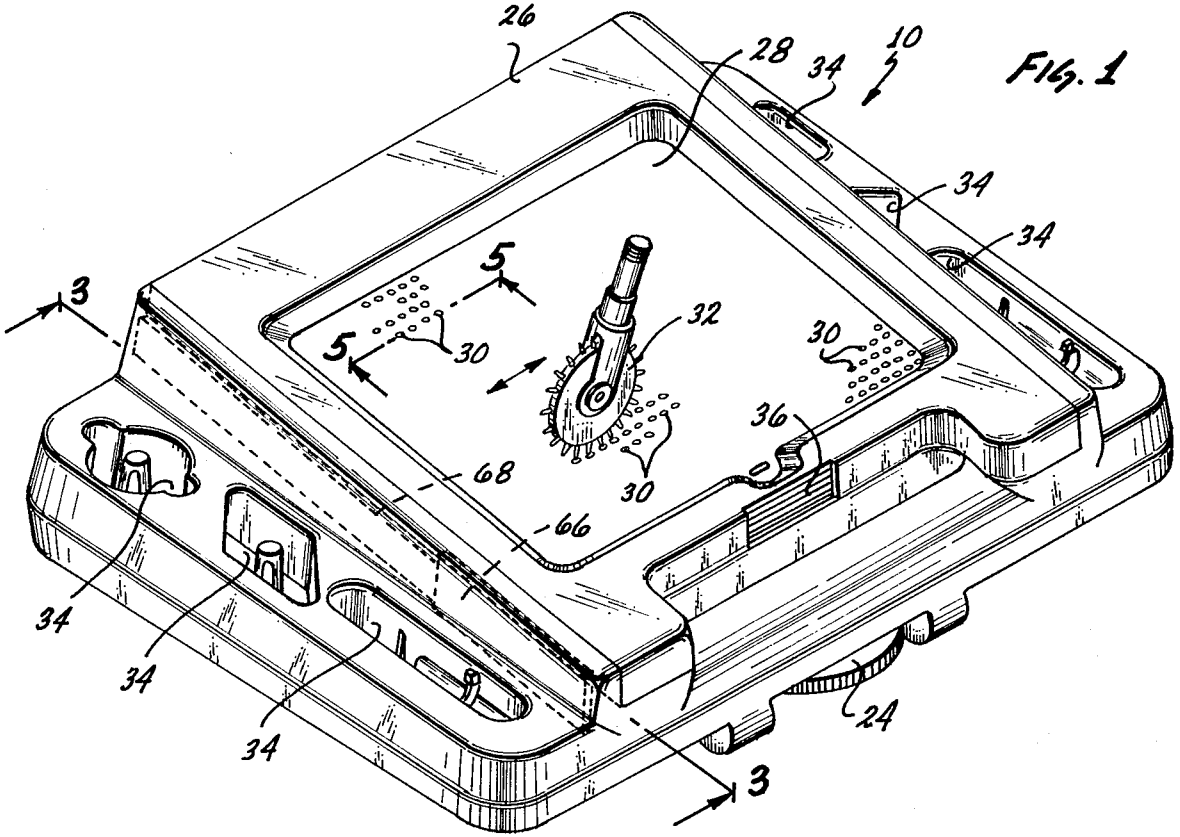
FIg. 1 is an isometric view showing an illustrative toy of this invention.

The invention disclosed in this specification and shown in the drawings utilizes certain principles and/or concepts as are set forth in the claims appended to this specification. Those skilled in the toy arts will realize that these principles and/or concepts are capable of being utilized in a variety of embodiments differing from the exact embodiment utilized for illustrative purposes herein. For this reason, this invention is not to be construed as being limited to the illustrative embodiment herein, but is only to be construed as being limited to the claims.

DETAILED DESCRIPTION OF THE INVENTION

In the Figures, a toy 10 incorporating this invention is illustrated. Within the toy 10 is a light 12 which is located in the center of a reflector 14. A battery 16 supplies current for the light 12 with the light from the light 12 then being reflected upwardly by the reflector 14.

The light 12 is located in the center of a multicolored dome 18, which is attached to a large spur gear 20. The spur gear 20 is free to rotate on a housing 22 located within the toy 10. The spur gear 20 intermeshes with spur gear 24, a portion of which extends outside of the toy 10 and can be seen in FIG. 1. The child, in utilizing the toy 10 rotates the spur gear 24 to create multicolored light patterns as hereinafter more fully explained.

A slidable housing 26 is located in the upper portion of the toy 10. As is seen in FIG. 1, within the housing 26 is an upper plate 28, which has a multiplicity of first openings, collectively identified by the numeral 30. The child, in playing with the toy 10, takes a small tool or the like, such as tool 32 shown in FIG. 1, and moves it along the upper plate 28 to create patterns by depressing the tool 32 inwardly into certain of the openings 30. In those areas wherein the tool 30 is depressed, light then shines through the openings 30 to create a pattern. By rotating the gear 24, the particular colored light which shines through any specific area of the upper plate 28 changes, depending upon the color scheme in the dome 18. A multiplicity of openings, collectively identified by the numeral 34 are located in the toy 10 for storage of different tools, such as the tool 32, shown.

After creating a pattern in the upper plate 28 with a tool such as tool 32, the child can then erase the pattern by sliding the housing 26 to the upper left, as seen in FIG. 1, by engaging the lip 36 with a digit and sliding the housing 26 upwardly and to the left as seen in FIG. 1. This causes all of the openings 30 which had been rendered light emitting by use of the tool 32 to close, such that that totality of all the openings 30 are then closed, with no light being shown through the upper plate 28.

Figure 2:
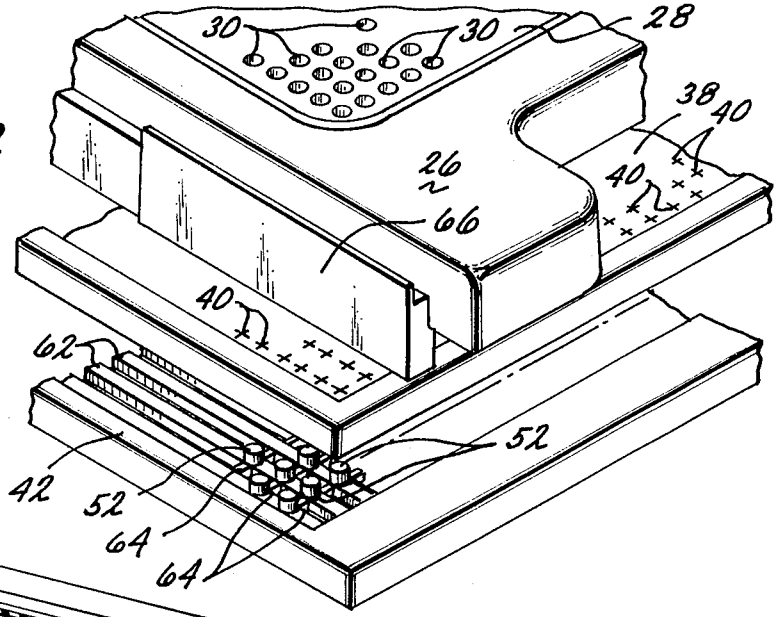
FIG. 2 is an exploded view of one of the components making up the toy of FIG. 1.

In viewing FIG. 2 it can be seen that located beneath the upper plate 28 is an opaque diaphragm 38. The diaphragm 38 has a plurality of crossed slits, collectively identified by the numeral 40, cut therein. Beneath the diaphragm 38 is a second or lower plate 42. The lower plate 42 has a plurality of openings, collectively identified by the numeral 44, located therein.

When the housing 26 is constructed, the openings 30 in the upper plate 28 are directly aligned over the crossed slits 40 in the diaphragm 38 and these, in turn, are directly in line with the lower openings 44 and the lower plate 42.

Figure 6:
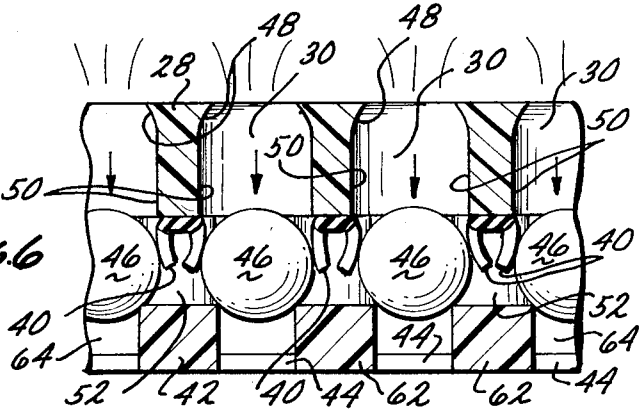
FIG. 6 is a view similar to FIG. 5 except certain components located therein are seen in a second configuration.
Figure 5:
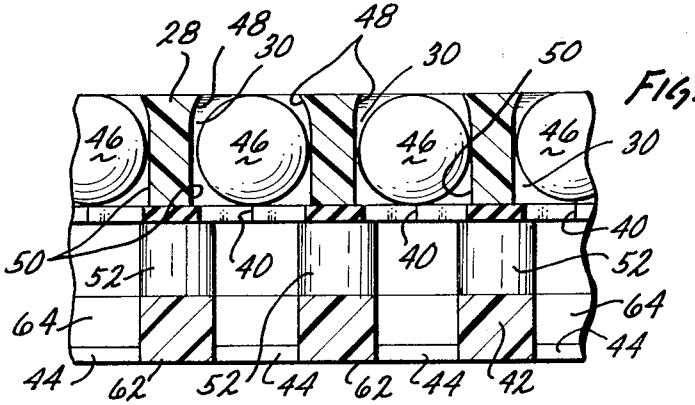
FIG. 5 is an exploded view of certain of the components seen in the upper right hand corner of FIG. 4, with these components being located in a first configuration.

Referring now to FIGS. 5 and 6, it can be seen that each of the openings 30 are in line with the crossed slits 40, and these, in turn, are in line with one of the lower openings 44. Except for the presence of the diaphragm 38 between the upper and lower plates 28 and 42, an optical pathway would exist between the openings 44 and the openings 30. The presence of the diaphragm 38 closes this optical pathway between the opening 44 and 30 except when the diaphragm 38 is displaced, opening the diaphragm 38 about the crossed slits 40. To open the diaphragm about the crossed slits 40, a transference sphere, collectively identified by the numeral 46, is located within each of the openings 30. The sphere 46 has two positions. A first position, as seen in FIG. 5, has the crossed slits 40 in a closed configuration, preventing transmission of light from the opening 44 to the opening 30. When the spheres 46 are depressed downwardly upon being engaged with a tool, such as tool 32, they move into the diaphragm 38 through the crossed slits 40, opening the crossed slits 40 such that a portion of the sphere 46 is located within the area of the crossed slits 40 with a second portion of a sphere 46 located down into the second plate abutting against the openings 44. This creates an optical pathway from the opening 44 to the opening 30 through the diaphragm 38, allowing for transmission of light from the opening 44 t the opening 30 and to the user of the toy 10.

As is evident from FIGS. 5 and 6, the openings 30 in the upper plate 28 are of a first diameter 48 near the upper surface of the plate 28 and a second diameter 50 elsewhere within the plate 28 in all areas from the diameter 48 towards the lower plate 44. The diameters 48 and 50 are chosen such that the diameter 48 is smaller than the diameter of the spheres 46, whereas the diameter 50 is greater than the spheres 46. Further, the diameter of the openings 44 in the lower plate 42 are also smaller than the diameter of the sphere 46. This allows for fixed retention of the spheres 46 within the confines of the openings 44 in the lower plate 42 and the diameter 48 in the opening 30 of the upper plate 28. The spheres 46, however, can be moved upwardly and downwardly within this channel to either open the diaphragm as seen in FIG. 6 or to close the diaphragm as seen in FIG. 5 at each of the crossed slits 40.

Located around the periphery of each of the openings 44 and formed as a portion of the lower plate 44 are pegs collectively identified by the numeral 52. The pegs 52 are positioned on the lower plate 42 such that four each of the pegs 52 surround each of the openings 44. The pegs 52 prevent the spheres from moving out of alignment with the respective openings 30 and 44 for each of the optical pathways created through the upper and lower plates 28 and 42. By use of the pegs 52, positioning of the spheres 46 is taken care of to maintain the sphers 46 in proper relationship to the openings 30 and 44 and the crossed slits 40.

The diaphragm 38 is made in a continuous piece with the crossed slits 40 located therein, as is evident from FIG. 2. Because the diaphragm 38 is of a continuous piece, when each of the little triangular wedges which border the periphery of the crossed slits 40 are pushed downwardly by location of the spheres 46 into the second, or lower, position as seen in FIG. 6, a section of each of the little triangular pieces of the diaphragm 38 are positioned above the horizontal plane of symmetry of each of the spheres 46 with the spheres 46 contacting the periphery of the openings 44 below the horizontal plane of symmetry of each of the spheres 46. This locks the spheres 46 in the second position to maintain the individual pathways of light from the openings 44 to the openings 30 open after they have so been appropriately opened by the use of a tool such as tool 32.

In a like manner, when the spheres 46 are located essentially in the first position within the upper plate 28 as seen in FIG. 5, the upward bias of the edges of the crossed slits 40 in the diaphragm 38 serve to maintain the spheres 46 in this upward position to maintain the individual crossed slits 40 in the apertures they form in the diaphragm 38 closed, inhibiting transmission of light through them. Thus, unless a particular sphere 46 is physically depressed downwardly into its associated crossed slits 40, the bias of the diaphragm 38 will maintain the individual aperture formed by the individual crossed slits 40 closed and when the spheres 46 is so physically depressed downwardly into the crossed slits 40, again the bias of the diaphragm 38 at its triangular areas adjacent to the crossed slits 40 will maintain the particular opening or light pathway open.

Figure 3:
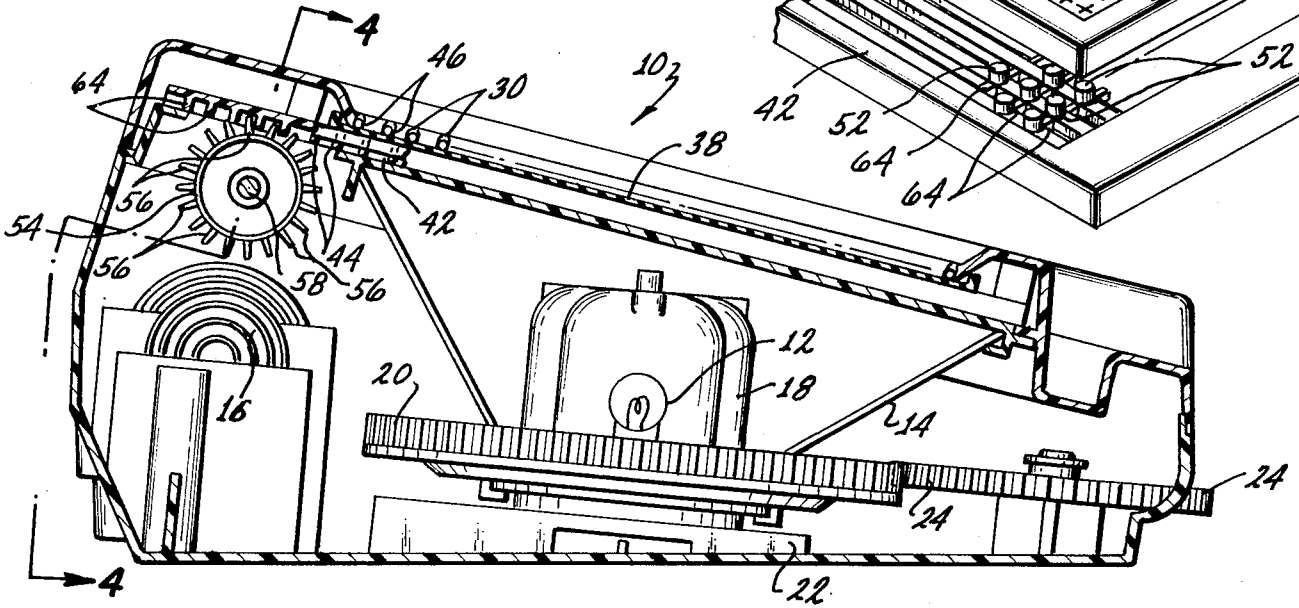
FIG. 3 is a side elevational view in partial section about the line 3—3 of FIG. 1.
Figure 4:
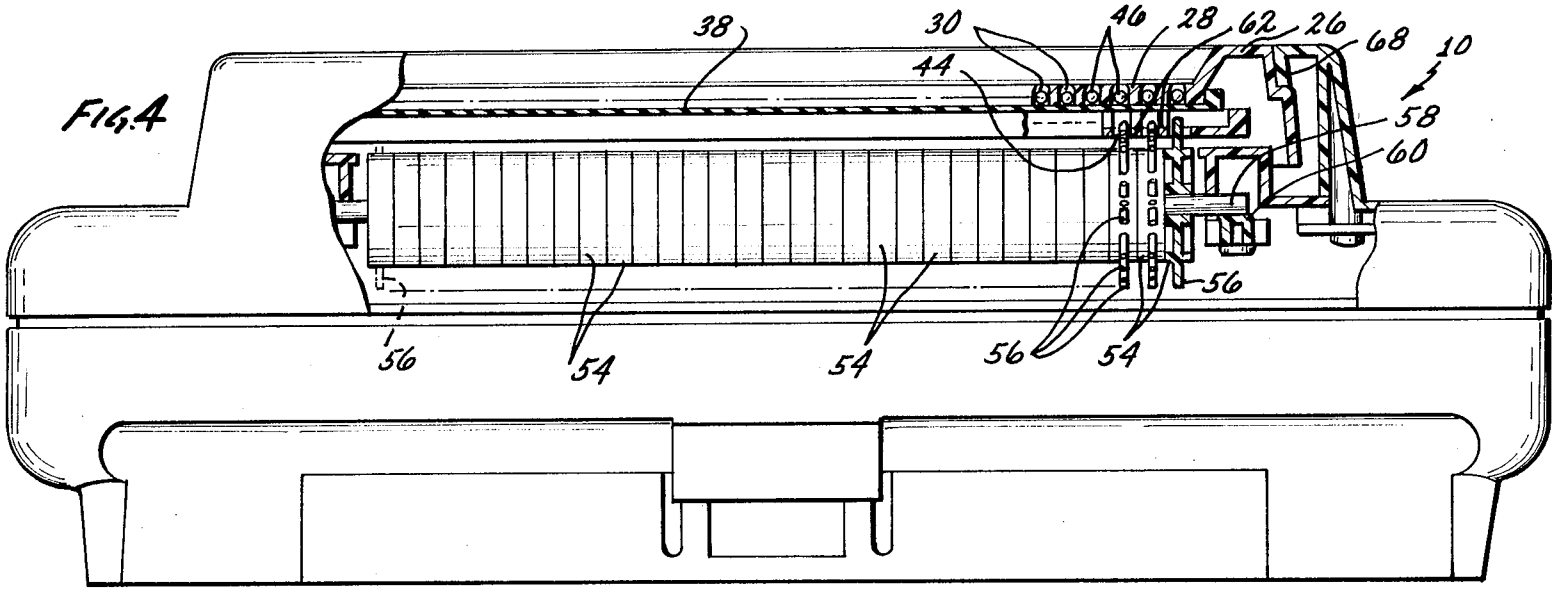
FIG. 4 is an end elevational view in partial section about the line 4—4 of FIG. 3.

As seen in FIGS. 3 and 4, located underneath the lower plate 42 along the upper edge of the toy 10 is a plurality of wheels collectively identified by the numeral 54 having a plurality of fingers collectively identified by the numeral 56 located thereon. Each of the wheels 54 can be rotated independently about an axle 58 on which they are mounted. The axle 58 is appropriately held within the toy 10 within a bearing 60 formed as a portion of the internal moldings of the toy 10.

The spacing between the fingers 56 is the same as the spacing between the individual holes 44 in the lower plate 42. When the housing 26 is slid by the user of the toy 10 upwardly as seen in FIG. 1, this causes the lower plate 42 to be drawn across the surface of the all of the wheels 54. As the plate 42 moves across the individual wheels 54 the individual fingers 56 located on these wheels engage any of the spheres 46 which are in the second, or downward position as seen in FIG. 6, and push them upwardly into the first position as seen in FIG. 5. Thus, when the housing 26 is moved upwardly and to the left as seen in FIG. 1, all of the spheres 46 are repositioned to the first position as seen in FIG. 5 with them being positioned within the upper plate 28 above the diaphragm 38 so as to close all of the apertures formed by the crossed slits 40. Thus, any pattern which had been created within the individual holes 38 in the upper plate 28 are erased upon movement of the housing 26 across the surface of the wheels 54 and their fingers 56 located thereon.

The lower plate 42 includes a plurality of longitudinal ribs 62 located adjacent to each of the holes 44 located therein. The longitudinal ribs 62 ensure that each of the individual fingers 56 of the individual wheels 54 remain associated with one line of openings 44 in the lower plate 42 to ensure smooth engagement of the fingers 56 against any of the spheres 46 which are located in the downward or second position as seen in FIG. 6. In combination with the ribs 62 the lower plate 42 also includes some transverse ribs 64. The criss-crossing of the transverse ribs 64 with the longitudinal ribs 62 forms the lower openings 44. As the housing 26 is moved with respect to the wheels 54, the fingers 56 engage the transverse ribs 64 rotating the wheels 54 such that it is the movement of the housing 26 which rotates the wheels 54 to reposition any of the spheres 46 from their second, open, positions to their upward, closed, positions. The housing 26 includes an appropriate longitudinal guide bar 66 located on each of its sides which engages with an appropriately positioned, downwardly directed ribs 68 formed on the under side of the top of the inside of the toy 10. This ensures smooth, even, linear motion of the housing 26 as it is slid to reposition the spheres 46 from their open to their closed position.

It is evident from the construction shown that the spheres 46 are permanently locked into position between the plates 28 and 42. As opposed to other games of the general type, which utilize pegs to create lighted patterns, it is impossible for the spheres 46 to become disengaged from the toy 10 and lost or misplaced. Further, since the diaphragm, 38 is preferredly formed of an elastic material which will retain its flat shape as seen in FIG. 5 once the distortion cause by the locating one of the spheres 46 within the crossed slits 40 is removed by repositioning the spheres 46 back to the first, or closed, position, it is not necessary to replace the diaphragm for each pattern or design which is created on the toy 10. Because of these features, the toy 10 has a long, useful life span, absenting the necessity of replacing movable pegs or single use diaphragms. While use of the toy 10 is shown with a tool such as tool 32, it is not necessary to actually use such tools in creating patterns on the toy 10. A ball point pen, or other similar blunt instrument can be utilized to depress the spheres 46 downwardly such that they engage within the crossed slits 40 and are located in the open position allowing for transmission of light through the optical pathway formed between the openings 44 and 30 for each particular line set of openings. The only requirement with respect to a tool for depressing the spheres 46 is that it be of a diameter smaller than the diameter 48 at the top of the openings 30. In actual production models of the toy 10, its diameter is sufficiently large such that a blunt point such as that of a ball point pen is more than adequate to depress the spheres 46 downwardly to the second, or closed, position.

I claim:

1. A toy for displaying an illuminated pattern which comprises:

a housing;

a first panel located in said housing;

a second panel located in said housing and spaced away from said first panel at a fixed distance;

said first panel including a plurality of first openings formed through said first panel;

said second panel including a plurality of second openings formed through said second panel, the number of said second openings equal to the number of said first openings with each of said second openings aligned with one of said first openings and together each of said aligned first and second openings forming an optical pathway through said first and said second panels;

an opaque membrane located between said first and said second panels, said opaque membrane having a plurality of aperture means for controlling the transmission of light through said membrane, the number of said aperture means equal in number to the number of said first and said second openings with one of said plurality of said aperture means positioned in each of said optical pathways between the respective first and second openings forming said optical pathway, each of said aperture means capable of reversibly being opened and closed and when open allowing light to be transmitted through said membrane and when closed inhibiting the transmission of light through said membrane;

a plurality of light conducting members equal in number to the number of said first and said second openings, said light conducting members fixedly retained in said housing in a location between said first and said second panels, said number of said light conducting members equal in number to the number of said first and said second openings with one of said light conducting members positioned in each of said optical pathways between the respective first and second openings forming an optical pathway and positionable in said optical pathway between a first position wherein said light conducting member is located between said first panel and said opaque membrane and said aperture is closed and a second position wherein at least a portion of said light conducting member is positioned in said aperture means in said opaque membrane to open said aperture means;

together said aperture means and light conducting member associated with each of said optical pathways allowing or inhibiting light transmission through said optical pathway, light being transmitted through said optical pathway when said light conducting member is in said second position to open said aperture means, light transmission through said optical pathway being inhibited when said light conducting member is in said first position and said aperture means is closed.

2. The toy of claim 1 including:

retaining means associated with said aperture means for retaining said aperture means open when said light conducting member associated therewith is in said second position.

3. The toy of claim 2 including:

reset means associated with said housing, said reset means for resetting each of said light conducting members in said first position.

4. The toy of claim 3 wherein:

said housing is movable with respect to said reset means and as said housing is moved with respect to said reset means said reset means resets said light conducting members to said first position.

5. The toy of claim 4 wherein:

each of said aperture means comprises a pair of crossed slits in said opaque membrane with said crossed slits forming an openable and closable optical pathway through said opaque membrane.

6. The toy of claim 5 wherein:

when each of said light conducting members are in said second position said portion of said light conducting members is located within said crossed slits to open said optical pathway through said opaque member.

7. The toy of claim 6 wherein:

each of said light conducting members comprises a spherical member formed of a light transmitting material.

8. The toy of claim 7 wherein:

said reset means includes a plurality of finger means each of which is capable of passing into one of said second openings and when passed into said second opening engaging said portion of said light conducting member located within said cross slits and relocating said light conducting member towards said first panel to disengage said portion of said light conducting member from its location within said crossed slits.

9. A toy for displaying an illuminated pattern which comprises:

a housing;

a first panel located in said housing;

a second panel located in said housing and spaced away from said first panel at a fixed distance;

said first panel including a plurality of first openings formed through said first panel;

said second panel including a plurality of second openings formed through said second panel, the number of said second openings equal to the number of said first openings with each of said second openings aligned with one of said first openings and together each of said aligned first and second openings forming an optical pathway through said first and said second panels;

an opaque membrane located between said first and said second panels, said opaque membrane having a plurality of aperture means for controlling the transmission of light through said membrane, the number of said aperture means equal in number to the number of said first and said second openings with one of said plurality of said aperture means positioned in each of said optical pathways between the respective first and second openings forming said optical pathway, each of said aperture means capable of being opened and closed and when open allowing light to be transmitted through said membrane and when closed inhibiting the transmission of light through said membrane;

a plurality of light conducting members equal in number to the number of said first and said second openings, said light conducting members fixedly retained in said housing in a location between said first and said second panels, said number of said light conducting members equal in number to the number of said first and said second openings with one of said light conducting members positioned in each of said optical pathways between the respective first and second openings forming an optical pathway and positionable in said optical pathway between a first position wherein said light conducting member is located between said first panel and said opaque membrane and said aperture is closed and a second position wherein at least a portion of said light conducting member is positioned in said aperture means in said opaque membrane to open said aperture means;

together said aperture means and said light conducting member associated with each of said optical pathways allowing or inhibiting light transmission through said optical pathway, light being transmitted through said optical pathway when said light conducting member is in said second position to open said aperture means, light transmission through said optical pthway being inhibited when said light conducting member is in said first position and said aperture means is closed;

retaining means associated with said aperture means for retaining said aperture means open when said light conducting member associated therewith is in said second position;

each of said aperture means comprises a pair of crossed slits in said opaque membrane with said crossed slits forming an openable and closable optical pathway through said opaque membrane;

said retaining means includes each of said second openings having projection means located in association with said second opening and projecting from said second opening towards said opaque membrane, said light conducting member when in said second position positionable proximal to said projection means to position a portion of said opaque membrane associated with said crossed-slits between said projection means and said opaque membrane to frictionally engage said light conducting member, said portion of said opaque membrane and said projection means to retain said light conducting member in said second position.

10. The toy of claim 9 wherein:

each of said light conducting members comprises a spherical member formed of a light transmitting material.

11. The toy of claim 10 wherein:

reset means associated with said housing, said reset means for resetting each of said light conducting members in said first position;

said reset means includes a plurality of finger means each of which is capable of passing into one of said second openings and when passed into said second opening engaging said portion of said light conducting member located within said cross slits and relocating said light conducting member towards said first panel to disengage said portion of said light conducting member from its location within said crossed slits.

12. The toy of claim 11 wherein:

said projection means comprises at least two projections spaced apart from one another about the periphery of said second opening.

13. The toy of claim 12 wherein:

said second openings are quadrilaterally shaped.

14. The toy of claim 13 wherein:

said projection means includes four projections symmetrically spaced about said periphery of said second openings.

15. The toy of claim 14 wherein:

said first openings are round in cross section and are frustoconically shaped in axial section.

16. A toy for displaying an illuminated pattern which comprises:

a housing;

a first panel located in said housing;

a second panel located in said housing and spaced away from said first panel at a fixed distance;

said first panel including a plurality of first openings formed through said first panel;

said second panel including a plurality of second openings formed through said second panel, the number of said second openings equal to the number of said first openings with each of said second openings aligned with one of said first openings and together each of said aligned first and second openings forming an optical pathway through said first and said second panels;

an opaque membrane located between said first and said second panels, said opaque membrane having a plurality of aperture means for controlling the transmission of light through said membrane, the number of said aperture means equal in number to the number of said first and said second openings with one of said plurality of said aperture means positioned in each of said optical pathways between the respective first and second openings forming said optical pathway, each of said aperture means capable of being opened and closed and when open allowing light to be transmitted through said membrane and when closed inhibiting the transmission of light through said membrane;

a plurality of light conducting members equal in number to the number of said first and said second openings, each of said light conducting members sized and shaped so as to be incapable of passing through either of said first or said second plurality of openings whereby said light conducting members are fixedly retained in said housing in a location between said first and said second panels, said number of said light conducting members equal in number to the number of said first and said second openings with one of said light conducting members positioned in each of said optical pathways between the respective first and second openings forming an optical pathway and positionable in said optical pathway between a first position wherein said light coducting member is located between said first panel and said opaque membrane and said aperture is closed and a second position wherein at least a portion of said light conducting member is positioned in said aperture means in said opaque membrane to open said aperture means;

together said aperture means and said light conducting member associated with each of said optical pathways allowing or inhibiting light transmission through said optical pathway, light being transmitted through said optical pathway when said light conducting member is in said second position to open said aperture means, light transmission through said optical pathway being inhibited when said light conducting member is in said first position and said aperture means is closed.

17. The toy of claim 16 including:

each of said light conducting members comprising a spherical shaped member formed of a light transmitting material, each of said spherical shaped members having a diameter larger than the smallest cross sectional portion of each of said first and said second openings such that said spherical members are incapable of passing through either of said first or said second openings.

18. The toy of claim 16 wherein:

each of said light conducting members is reversibly frictionally held in said second position to reversibly hold its associated aperture means in an open position so as to allow light conduction between said first and said second openings associated with the respective light conducting member and aperture means.

* * * * *

UNITED STATES PATENT AND TRADEMARK OFFICE

CERTIFICATE OF CORRECTION

PATENT NO. : 4,541,812

DATED : SEPTEMBER 17, 1985

INVENTOR(S) : FUYUKI KATSUMATA

It is certified that error appears in the above-identified patent and that said Letters Patent is hereby corrected as shown below:

Column 1, Line 58 "elemens" should be --elements--.
Column 2, line 22 "peg" should be --opaque--.
Column 5, line 6 "and" should be --of--.
Column 5, line 34 "t" should be --to--.
Column 5, line 53 the second occurrence of "44" should be --42--.
Column 5, line 56 delete the word "each".
Column 5, line 62 "sphers" should be --spheres--.
Column 6, line 10 delete the word "so".
Column 6, line 23 "spheres" should be --sphere--.
Column 6, line 41 delete the second occurrence of the word "the".
Column 6, line 53 "38" should be --30--.
Column 7, line 21 "cause" should be --caused--.
Column 9, line 64 "pthway" should be --pathway--.
Column 11, line 27 "coducting" should be --conducting--.

Signed and Sealed this

*Eleventh* Day of *March 1986*

[SEAL]

*Attest:*

DONALD J. QUIGG

*Attesting Officer*

*Commissioner of Patents and Trademarks*